United States Patent [19]

Kosugi

[11] Patent Number: 4,652,840

[45] Date of Patent: Mar. 24, 1987

[54] ULTRAHIGH-FREQUENCY SWITCH

[75] Inventor: Yuhei Kosugi, Tokyo, Japan

[73] Assignee: NEC Corporation, Tokyo, Japan

[21] Appl. No.: 755,127

[22] Filed: Jul. 15, 1985

[30] Foreign Application Priority Data

Jul. 20, 1984 [JP] Japan ..... 59-150929

[51] Int. Cl.[4] ..... H01P 1/10

[52] U.S. Cl. ..... 333/105; 333/108; 333/259; 333/262

[58] Field of Search ..... 333/101, 105, 108, 26, 333/34, 35, 258, 259, 262; 335/4, 5; 200/153 S

[56] References Cited

U.S. PATENT DOCUMENTS

| | | | |
|---|---|---|---|
| 2,997,675 | 8/1961 | Anderson | 333/262 X |
| 3,036,282 | 5/1962 | Lanctot | 333/262 |
| 3,086,181 | 4/1963 | Lind | 333/34 |
| 3,092,771 | 6/1963 | Cohn | 333/258 X |
| 3,182,270 | 5/1965 | Horton | 333/105 |
| 3,278,865 | 10/1966 | Forrer | 333/258 X |
| 3,414,849 | 12/1968 | Burt, Jr. | 333/105 |
| 3,737,812 | 6/1973 | Gaudio et al. | 333/34 X |
| 4,413,243 | 11/1983 | Dydyk | 333/262 X |
| 4,458,222 | 7/1984 | Herstein et al. | 333/35 X |

FOREIGN PATENT DOCUMENTS 5370647 12/1976 Japan .

*Primary Examiner*—Paul Gensler

*Attorney, Agent, or Firm*—Sughrue, Mion, Zinn, Macpeak & Seas

[57] ABSTRACT

An ultrahigh frequency switch is disclosed which features a desirable frequency characteristic, significantly short switching time, and small-size construction. Impedance conversion members serving as input and output terminals are connected between a waveguide and an opening and closing switch section. An elongate and flat movable center conductor in a strip-line configuration is driven from the outside to in turn open and close the impedance conversion members, thereby opening and closing the circuit.

10 Claims, 11 Drawing Figures

ULTRAHIGH-FREQUENCY SWITCH

BACKGROUND OF THE INVENTION

The present inention relates to an ultrahigh frequency switch which is applicable up to a high frequency range above 18 GHz and provided with mechanical contacts.

Switching circuits which are operable with frequencies higher than 18 GHz (hereinafter referred to as quasimillimeter waves) may generally be classified into four types, i.e., a waveguide switch type, a coaxial switch type, a diode switch type, and a ferrite switch type.

The waveguide switch type circuit is produced by boring a part of a waveguide and mounting a rotor in the bore, the rotor being rotatable to switch the waveguide paths. This type of circuit shows significantly low insertion losses and remarkable cut-off attenuation between non-connect ports and, thereby, represents a minimum of ohmic loss on the inner surface of the waveguide to withstand passage of larger power. However, the applicable range of such a switching circuit is quite limited due to the intricate construction, large amount of switching energy, and long switcing time.

The coaxial switch type circuit includes movable center conductors in a strip line configuration which are caused into opening and closing actions toward and away from stationary contacts connected to coaxial connectors. While this type of switching circuit has a simple construction, ensures substantial cut-off attenuation, and shortens the switching time, the insertion loss undesirably increases at frequencies higher than several GHz to thereby degrade the matching condition.

The diode switch type circuit is an effective solution to the switching time problem. Nevertheless, it is unsatisfactory from the characteristics standpoint because, for example, the insertion loss is relatively high and the cut-off attenuation available therewith is not so great.

Further, the ferrite type circuit is constructed to reverse the flux direction biased on a ferrite member which is inserted in the circuit. The problem with this switching circuit is that for the flux reversal it consumes substantial energy and, in addition, the insertion loss and matching condition become poor in the ultrahigh frequency range.

With such merits and demerits of various types of switching circuits known in the art in mind, a very small switch for a waveguide which is equivalent in switching time to the previously mentioned coaxial switch type circuit and which has relatively small insertion loss even in the quasimillimeter band has been proposed as disclosed in Japanese Patent Application No. 51-146771. Using movable center conductors having a stripline configuration as switching elements, the disclosed miniature switch is capable of implementing various kinds of switch configuration such as a double-pole double-throw switch in a simple structure. However, due to the use of coaxialwaveguide transducers for a waveguide interface, the miniature switch allows the voltage standing wave ratio (VSWR) and insertion loss to increase with the circuit frequency.

SUMMARY OF THE INVENTION

It is therefore an object of the present invention to provide an ultrahigh frequency switch which is free from degradation of characteristics even at frequencies higher than 18 GHz.

It is another object of the present invention to provide a generally improved ultrahigh frequency switch.

An ultrahigh frequency switch for switching a signal which lies in an ultrahigh frequency range of the present invention comprises a plurality of terminals to which the ultrahigh frequency signal is applied, intermediating members made of movable conductors for establishing and interrupting interconnection between the terminals, each of the intermediating members constituting an elongate and flat center conductor in a strip line configuration which has a low circuit characteristic impedance, and an impedance matching member for matching the strip line and the waveguide terminals.

In accordance with the present invention, an ultrahigh frequency switch features a desirable frequency characteristic, significantly short switching time, and small-size construction. Impedance transformer members are connected between a waveguide serving as input and output terminals and an opening and closing switch section. Elongate and flat movable center conductors in a strip-line configuration are driven from the outside to in turn open and close the impedance transformer members, thereby opening and closing the circuit.

The above and other objects, features and advantages of the present invention will become more apparent from the following description taken with the accompanying drawings.

DESCRIPTION OF THE PREFERRED EMBODIMENTS

While the ultrahigh frequency switch of the present invention is susceptible of numerous physical embodiments, depending upon the environment and requirements of use, substantial numbers of the herein shown and described embodiments have been made, tested and used, and all have performed in an eminently satisfactory manner.

Figure 1:
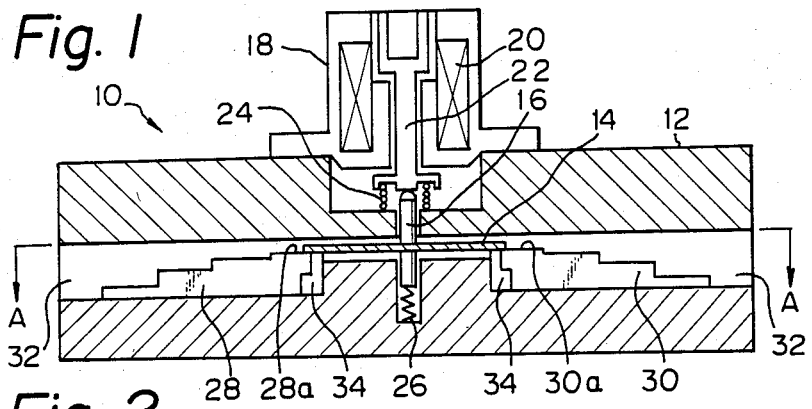
FIG. 1 is a vertical section of an ultrahigh frequency switch embodying the present invention.
Figure 2:
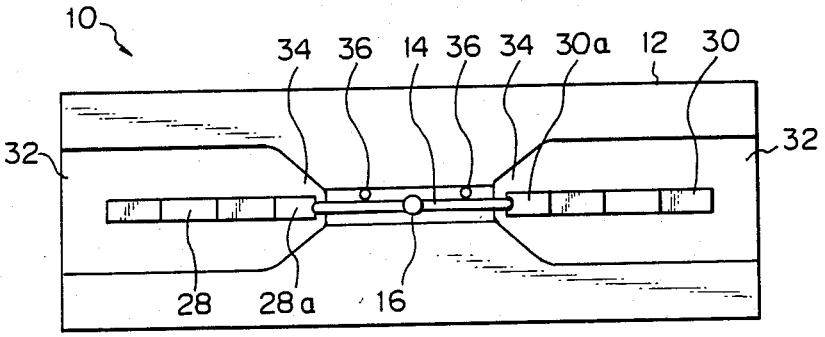
FIG. 2 is a section along line A—A of FIG. 1.
Figure 3:
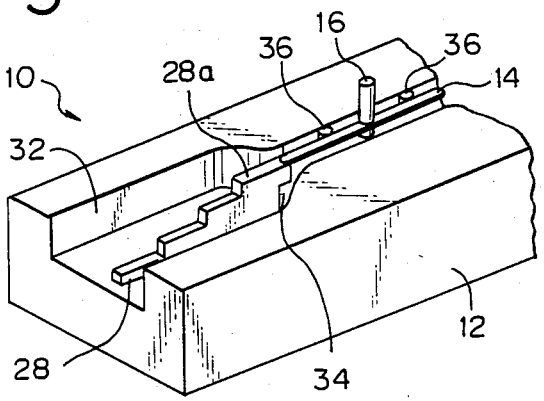
FIG. 3 is a perspective view of a left half of the switch shown in FIG. 2.

Referring to FIGS. 1–3, an ultrahigh frequency switch embodying the present invention is shown and generally designated by the reference numeral 10. The switch 10 includes a housing 12 in which a movable center conductor 14 having a flat and elongate configuration is disposed. A drive rod 16 is mounted on the center conductor 14. A solenoid 18 has a coil 20 and a plunger 22 which is movable up and down responsive to energization or deenergization of the coil 20 to in turn actuate the center conductor 14 and drive rod 16.

Figure 4:
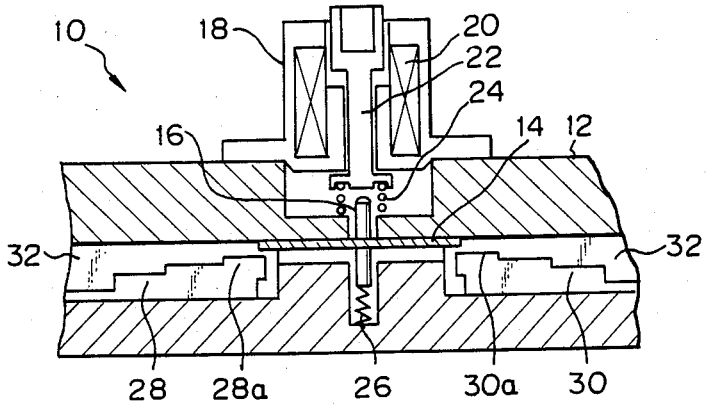
FIG. 4 shows in a vertical section the switch of FIG. 1 which is in an open position.

In this particular embodiment, when the coil 20 is energized, the plunger 22 is moved downwardly against the action of a return spring 24 to in turn press the drive rod 16 downwardly overcoming the action of a coil spring 26. Then, the center conductor 14 which is integral with the drive rod 16 makes electrical contact with contact surfaces 28*a* and 30*a* of impedance conversion members, or input terminals, 28 and 30 at the underside of its opposite ends. As the coil 20 is deenergized, the plunger 22 is urged upwardly by the action of the return spring 24 and, so, the center conductor 14 by the coil spring 26. As a result, the upper surface of the center conductor 14 is brought into contact with the underside of the housing 12, as shown in FIG. 4. Although not shown in the drawing, this part of the housing 12 is maintained at the same potential as an external conductor of the waveguide and, hence, a substantial amount of attenuation develops between the center conductor 14 which is engaged with that housing portion and the waveguide circuit.

While the waveguide of the switch 10 normally has a $TE_{10}$ mode opening 32, the impedance conversion members 28 and 30 are designed such that their impedance becomes lowest at the innermost contact surfaces 28*a* and 30*a*. In the illustrative embodiment, each of the impedance conversion members 28 and 30 is provided in a multi-ridge configuration; the housing 12 is provided with a cavity 34 in the vicinity of the contact surfaces 28*a* and 30*a* to thereby define a sufficient distance for isolation. Theoretically, if the characteristic impedance associated with the contact surfaces 28*a* and 30*a* is matched with that associated with the center conductor 14, which is a strip line, a low VSWR will be accomplished over a wide band. However, about 60–85 ohms of characteristic impedance will suffice practical applications. As described above, one of characteristic features of the present invention is that switching occurs in that portion of the waveguide path where the characteristic impedance is lower than the rest.

In FIG. 3, guides 36 are adapted to guide the center conductor 14 such that the latter moves in a predetermined direction without shaking. This allows the distance of movement of the center conductor 14 to be designed long enough to set up a sufficient amount of attenuation.

Figure 5:
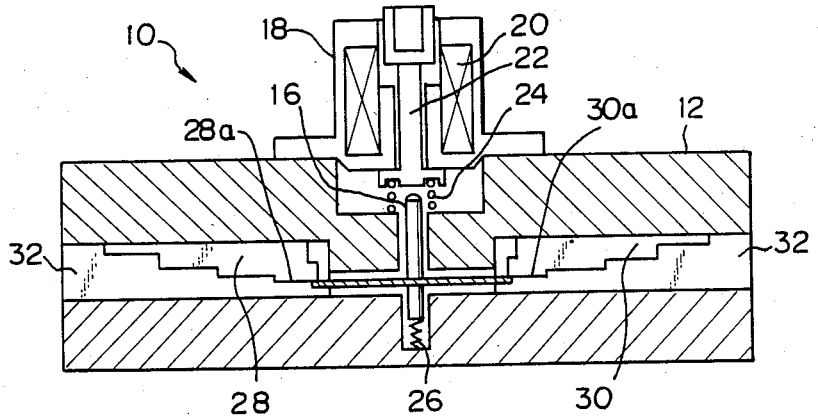
FIG. 5 is a vertical section showing a construction which is applicable to a case wherein a solenoid coil is energized in the opposite relation to FIG. 1.

In this particular embodiment, the waveguide path is normally open, and closed when the coil 20 of the solenoid 18 is energized. In the case of a waveguide path which is normally closed and opened during transmission of an externally derived signal, the impedance conversion members 28 and 30 may be positioned upside down as shown in FIG. 5.

Figure 6:
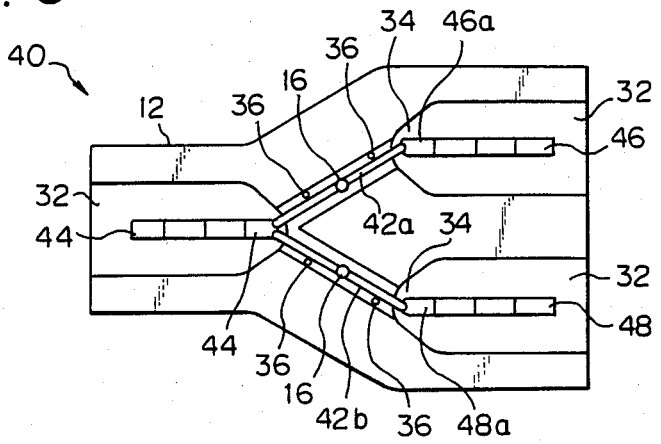
FIG. 6 is a plan view of another embodiment of the present invention having input terminals arranged for single-pole double-throw switching.

Referring to FIG. 6, a second embodiment of the present invention is shown. A switch, generally 40, includes impedance conversion members, or input terminals, which are arranged not in a single-pole single-throw configuration but in a single-pole double-throw configuration. The switch 40 in this case is provided with two movable center conductors 42*a* and 42*b*. Regarding the single-pole double-throw arrangement, one end of the conductor 42*a* makes contact with a contact surface 44*a* of an input side impedance conversion member 44 and the other end with a contact surface 46*a* of an output side impedance conversion member 46, while one end of the conductor 42*b* makes contact with a contact surface 44*a* of an input side impedance conversion member 44. and the other end with another contact surface 48*a* of an output side impedance conversion member 48. In this construction, the contact surface 44*a* of the input side impedance conversion member 44 is provided with a larger area than the contact surface 28*a* of the impedance conversion member 28 of the first embodiment in order to accommodate the ends of the two center condutors 42*a* and 42*b*.

Figure 7:
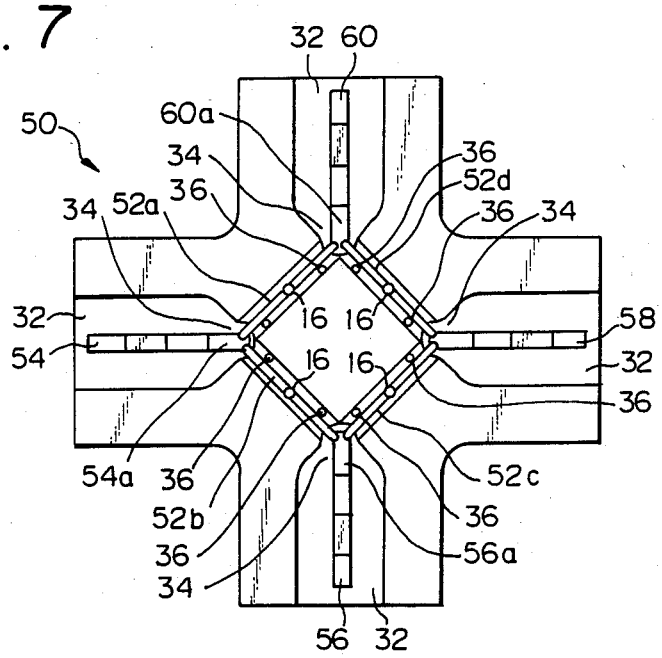
FIG. 7 is a plan view of another embodiment of the present invention having input terminals arranged for double-pole double-throw switching.

Referring to FIG. 7, still another embodiment of the present invention is shown. A switch, generally 50, includes impedance conversion members, or output terminals, which are arranged in a double-pole double-throw configuration. In this case, therefore, the switch 50 is provided with four movable center conductors 52*a*, 52*b*, 52*c* and 52*d*, input side impedance conversion members 54 and 56, and output side impedance conversion members 58 and 60. Opposite ends of the conductor 52*a* respectively are engageable with the contact surfaces 54*a* and 60*a* of the impedance conversion members 54 and 60, opposite ends of the conductor 52*b* with contact surfaces 54*a* and 56*a* of the impedance conversion members 54 and 56, opposite ends of the conductor 52*c* with contact surfaces 56*a* and 58*a* of the impedance conversion members 56 and 58, and opposite ends of the conductor 52*d* with contact surfaces 58*a* and 60*a* of the impedance conversion members 58 and 60.

Figure 8:
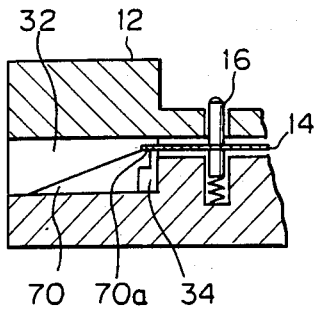
FIG. 8 is a fragmentary vertical section showing a linear impedance transformer arrangement.
Figure 9:
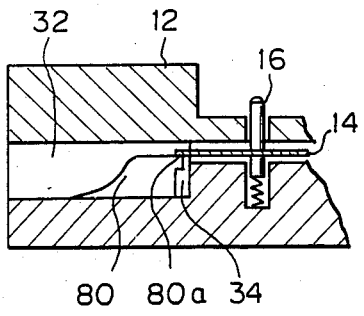
FIG. 9 is a fragmentary vertical section showing a special function impedance transformer arrangement.

While the impedance conversion members in any of the foregoing embodiments have been provided with a stepped-ridge configuration, they may alternatively be provided with a linear tapered transformer type configuration as represented by an impedance conversion member 70 having a contact surface 70*a* shown in FIG. 8, or a special function type configuration as represented by an impedance conversion member 80 having a contact surface 80*a* shown in FIG. 9.

Figure 10:
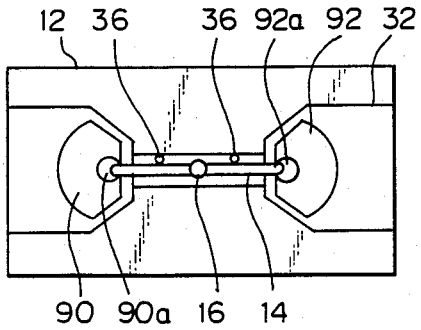
FIG. 10 is a plan view of a cone type impedance transformer arrangement.
Figure 11:
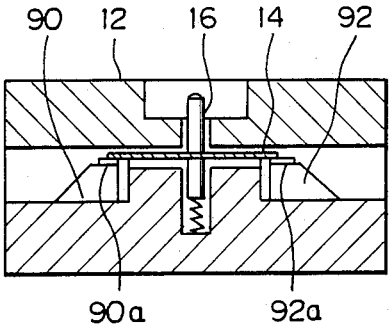
FIG. 11 is a vertical section of the arrangement shown in FIG. 10.

Further, in order to reduce the overall dimensions of the switch, the ridge type impedance conversion members may be replaced with conical impedance conversion members 90 and 92 as shown in FIGS. 10 and 11. The conical members 90 and 92 are provided with contact surfaces 90*a* and 92*a*, respectively. The conical configuration slightly narrows the band width but is favorably applicable to a circuit in which importance is placed on a small-sized construction rather than characteristics.

In summary, it will be seen that the present invention provides an ultrahigh frequency switch which shows a desirable frequency characteristic and low insertion loss and cuts down the switching time, even in a high frequency range above 18 GHz. The switch of the present invention is applicable to various kinds of input and output terminals, consumes a minimum of switching energy, achieves a compact configuration, and can be put to practical use at low costs.

Various modifiations will become possible for those skilled in the art after receiving the teachings of the present disclosure without departing from the scope thereof.

What is claimed is:

1. An ultrahigh frequency switch for switching signals in the ultrahigh frequency range between a first waveguide and n second waveguides (where n equals 1, 2, 3 . . . n) comprising:

first waveguide interface means adapted to be electrically coupled to the first waveguide;

n second waveguide interface means adapted to be electrically coupled to the n second waveguides;

a plurality of contoured waveguide mode transducers, one of said transducers being mounted in each of said waveguide interface means and each of said transducers having an end portion;

n strip line transmission paths, each of said paths being adapted to electrically connect said first waveguide interface means to said n second waveguide interface means, each of said strip line transmission paths comprising a fixed conductor and a movable strip conductor, said movable strip conductor being supported at substantially the center thereof by a dielectric rod, each movable strip conductor being adapted to move from a first position to a second position.

in said first position, the movable strip conductor being in contact with the end portion of the waveguide transducer in said first waveguide interface means and the end portion of the respective waveguide transducer in said second waveguide interface means, said strip line transmission path having a predetermined impedance in said first position, whereby an impedance-matched single closed circuit is completed between said first waveguide and said n second wave guides, and in said second position, said movable strip conductor being out of contact with the end portions of the first and second waveguide transducers but in contact with said fixed conductor, thereby establishing an open circuit.

2. An ultrahigh frequency switch as claimed in claim 1, wherein said contoured waveguide transducers are stepped-ridge type members.

3. An ultrahigh frequency switch as claimed in claim 1, wherein said contoured waveguide transducers are linear proportion type members.

4. An ultrahigh frequency switch as claimed in claim 1, wherein said contoured waveguide transducers are special function type members having a geometry that establishes a predetermined impedance characteristic.

5. An ultrahigh frequency switch as claimed in claim 1, wherein said contoured waveguide transducers are cone type members.

6. An ultrahigh frequency switch for switching signals in the ultrahigh frequency range between two first waveguides and two second waveguides comprising:

two first waveguide interface means adapted to be electrically coupled to each of the first waveguides.

two second waveguide interface means adapted to be electrically coupled to each of the second waveguides;

said first and second waveguide interface means being arranged in a planar array such that each of said first and second waveguide interface means has adjacent to it another first and second interface means and each of said first and second waveguide interface means has disposed across from it a second and a first waveguide interface means, respectively;

a plurality of contoured waveguide mode transducers, one of said transducers being mounted in each of said first and said second waveguide interface means and each of said transducers having an end portion;

a plurality of strip line transmission paths, each of said paths being adapted to electrically connect one of said waveguide interface means to an adjacent one of said waveguide interface means, each of said strip line transmission paths comprising a fixed conductor and a movable strip conductor, said movable strip conductor being supported at substantially the center thereof by a dielectric rod, each movable strip conductor being adapted to move from a first position to a second position.

in said first position, the movable strip conductor being in contact with the end portion of the waveguide transducer in said one of said interface means and the respective waveguide transducer in said adjacent interface means, said strip line transmission path having a predetermined impedance in said first position, whereby an impedance-matched single close circuit is completed between said one waveguide interface means and said adjacent waveguide interface means, in said second position, said movable strip conductor out of contact with the end portions of said one and said adjacent interface means but in contact with said fixed conductor, thereby establishing an open circuit, the movable strip conductors which face each other being paired and brought into and out of contact alternately with the adjacent movable strip conductors.

7. An ultrahigh frequency switch as claimed in claim 6, wherein said contoured waveguide transducers are stepped-ridge type members.

8. An ultrahigh frequency switch as claimed in claim 6, wherein said contoured waveguide transducers are linear proportion type members.

9. An ultrahigh frequency switch as claimed in claim 6, wherein said contoured waveguide transducers are special function type members having a geometry that establishes a predetermined impedance characteristic.

10. An ultrahigh frequency switch as claimed in claim 6, wherein said contoured waveguide transducers are cone type members.

* * * * *